US006241249B1

(12) United States Patent
Wang

(10) Patent No.: US 6,241,249 B1
(45) Date of Patent: Jun. 5, 2001

(54) PUZZLE BLOCK

(76) Inventor: Meng Theng Wang, P.O. Box 82-144, Taipei (TW)

( * ) Notice: Subject to any disclaimer, the term of this patent is extended or adjusted under 35 U.S.C. 154(b) by 0 days.

(21) Appl. No.: 09/358,472

(22) Filed: Jul. 21, 1999

(51) Int. Cl.[7] ..... A63F 9/08
(52) U.S. Cl. ..... 273/156
(58) Field of Search ..... 273/153 R, 153 S, 273/156, 157 R; 446/92

(56) References Cited

U.S. PATENT DOCUMENTS

| | | | | |
|---|---|---|---|---|
| 2,939,243 | * | 6/1960 | Duggar | 446/92 |
| 3,095,668 | * | 7/1963 | Dorsett | 446/92 |
| 3,254,440 | * | 6/1966 | Dubbar | 446/92 |
| 3,655,201 | * | 4/1972 | Nichols | 273/153 S |
| 5,409,236 | * | 4/1995 | Therrien | 273/156 |
| 5,520,396 | * | 5/1996 | Therrien | 273/156 |

* cited by examiner

*Primary Examiner*—Steven Wong
(74) *Attorney, Agent, or Firm*—A & J

(57) ABSTRACT

A puzzle block, which includes one first square block, which has magnet at each of the six sides thereof, 6 second square blocks, which has a magnet at each of four sides thereof and a metal sheet at one of the other two sides thereof, 12 third square blocks, which has a magnet at each of two opposite sides thereof and two metal sheets respectively provided at two adjacent sides thereof between the two opposite sides which carry a respective recessed hole, and 8 fourth square blocks, which has a plurality of metal sheets respectively provided at three adjacent sides thereof, wherein the square blocks are attached to one another forming a combination block such that the magnets at the first square blocks respectively attract the metal sheet at each of the second square blocks, the metal sheets at the third square blocks are respectively attracted by the magnets at the second square blocks, and the metal sheets at the fourth square blocks are respectively attracted by the magnets at the third square blocks.

1 Claim, 6 Drawing Sheets

PUZZLE BLOCK

BACKGROUND OF THE INVENTION

The present invention relates to a puzzle blocks, and more particularly to such a puzzle block, which is comprised of total 27 square blocks connected to one another by magnetic attraction, and arranged into a combination square block.

A regular puzzle block is comprised of 27 small square blocks of different colors mechanically coupled to one another, forming six sides, each side formed of 9 small square blocks. By rotating the square blocks relative to one another, the puzzle block can be set to show any of a variety of color combinations. This puzzle block is practical for training one's brainpower. However, because the small square blocks of the puzzle block are connected to one another mechanically, the user cannot disconnect the small square blocks from one another for a re-arrangement.

SUMMARY OF THE INVENTION

It is the main object of the present invention to provide a puzzle block, which is comprised of a plurality of small square blocks detachably connected to one another by magnetic attraction. It is another object of the present invention to provide a puzzle block, which keeps small square blocks to be connected to one another by magnetic attraction and, allows the small square blocks to be rotated relative to one another. To achieve these and other objects of the present invention, there is provided a puzzle block comprised of one first square block, which has magnet at each of the six sides thereof, 6 second square blocks, which has a magnet at each of four sides thereof and a metal sheet at one of the other two sides thereof, 12 third square blocks, which has a magnet at each of two opposite sides thereof and two metal sheets respectively provided at two adjacent sides thereof between the two opposite sides which carry a respective recessed hole, and 8 fourth square blocks, which has a plurality of metal sheets respectively provided at three adjacent sides thereof. The square blocks are attached to one another forming a combination block such that the magnets at the first square blocks respectively attract the metal sheet at each of the second square blocks, the metal sheets at the third square blocks are respectively attracted by the magnets at the second square blocks, and the metal sheets at the fourth square blocks are respectively attracted by the magnets at the third square blocks.

DETAILED DESCRIPTION OF THE PREFERRED EMBODIMENT

Referring to Figures from 1 through 10, a puzzle block is comprised of 27 square blocks including one first square block A, 6 second square blocks B, 12 third square blocks C, and 8 fourth square blocks D.

Figure 2:
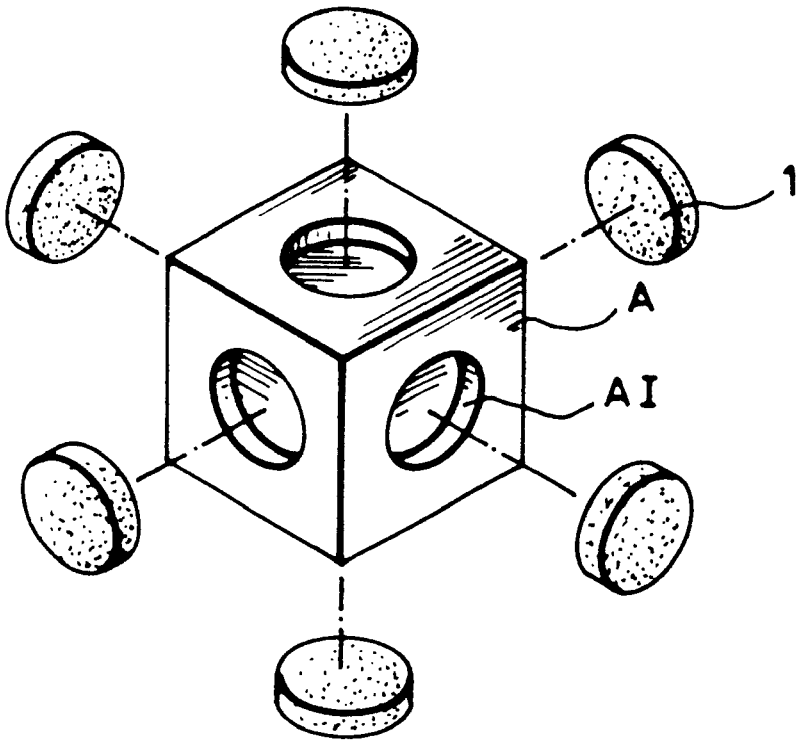
FIG. 2 is an exploded view of a first square block according to the present invention.
Figure 3:
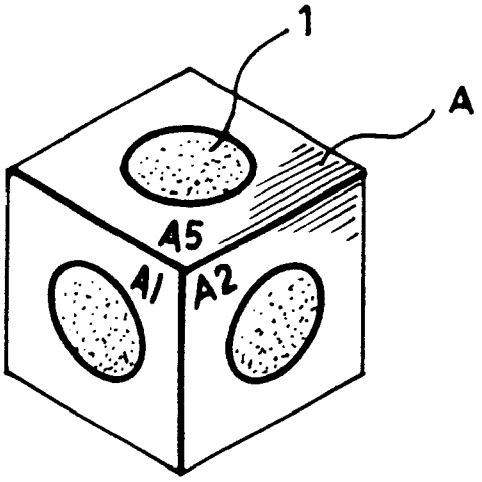
FIG. 3 is an assembly view of FIG. 2.

Referring to FIGS. 2 and 3, the first square block A comprises a recessed hole A1 at each of the six sides thereof (see FIG. 2). A respective magnet 1 is fixedly mounted in the recessed hole A1 at each of the six sides in a flush manner (see FIG. 3). The magnet 1 can be fastened to the recessed hole A1 by, for example, an adhesive.

Figure 4:
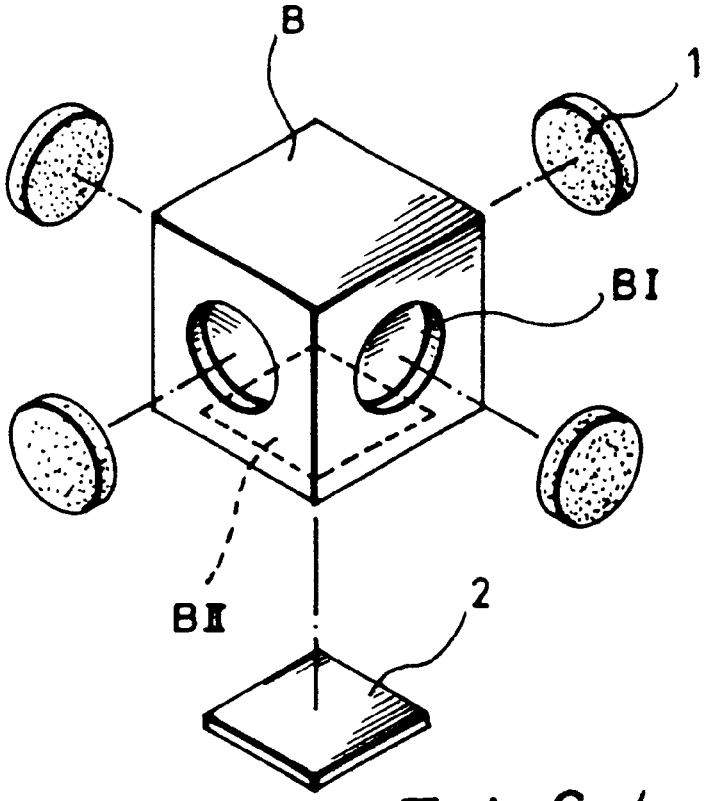
FIG. 4 is an exploded view of a second square block according to the present invention.
Figure 5:
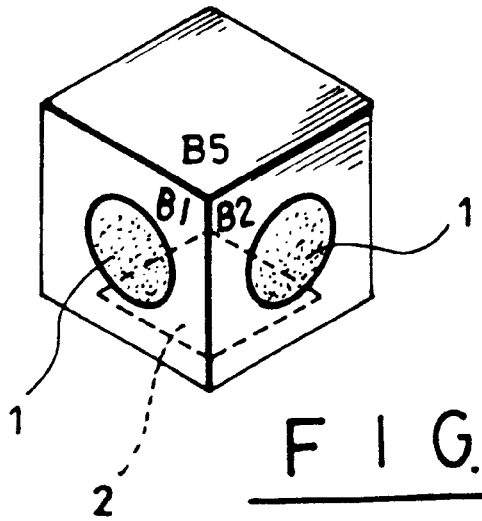
FIG. 5 is an assembly view of FIG. 4.

Referring to FIGS. 4 and 5, the second square block B comprises a recessed hole B1 at one of the four peripheral sides thereof (see FIG. 4), and a flat recess BII at one of the other two sides thereof. A respective magnet 1 is fixedly mounted in the recessed hole B1 at each of the four peripheral sides of the second square block B in a flush manner. A metal sheet 2 is fixedly mounted in the flat recess BII at the second square block B in a flush manner.

Figure 6:
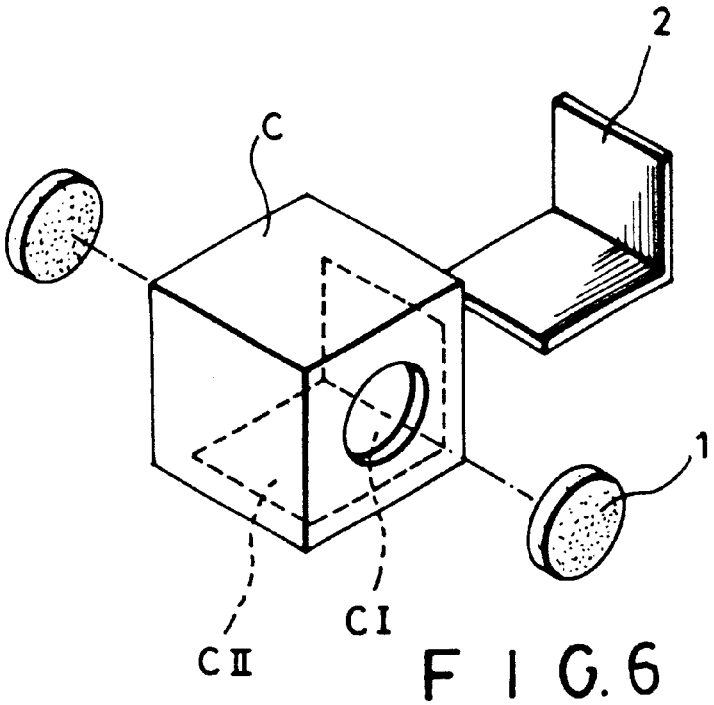
FIG. 6 is an exploded view of a third square block according to the present invention.
Figure 7:
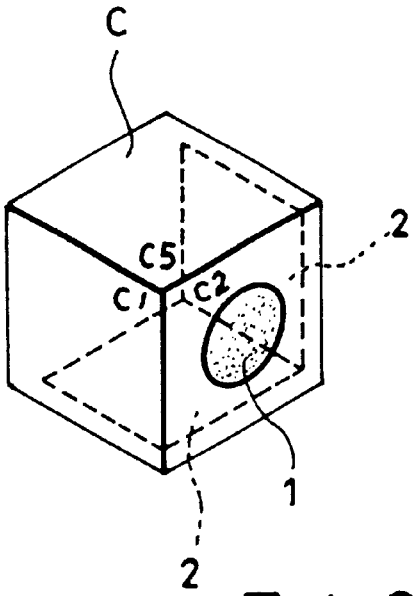
FIG. 7 is an assembly view of FIG. 6.

Referring to FIGS. 6 and 7, the third square block C comprises a recessed hole C1 at each of two opposite sides thereof, and a flat recess CII extended over two adjacent sides between the two opposite sides which carry a respective recessed hole C1. A respective magnet 1 is fixedly mounted in each recessed hole C1 at the third square block C in a flush manner. An angled metal sheet 2 is fixedly mounted in the flat recess CII at the third square block B in a flush manner.

Figure 8:
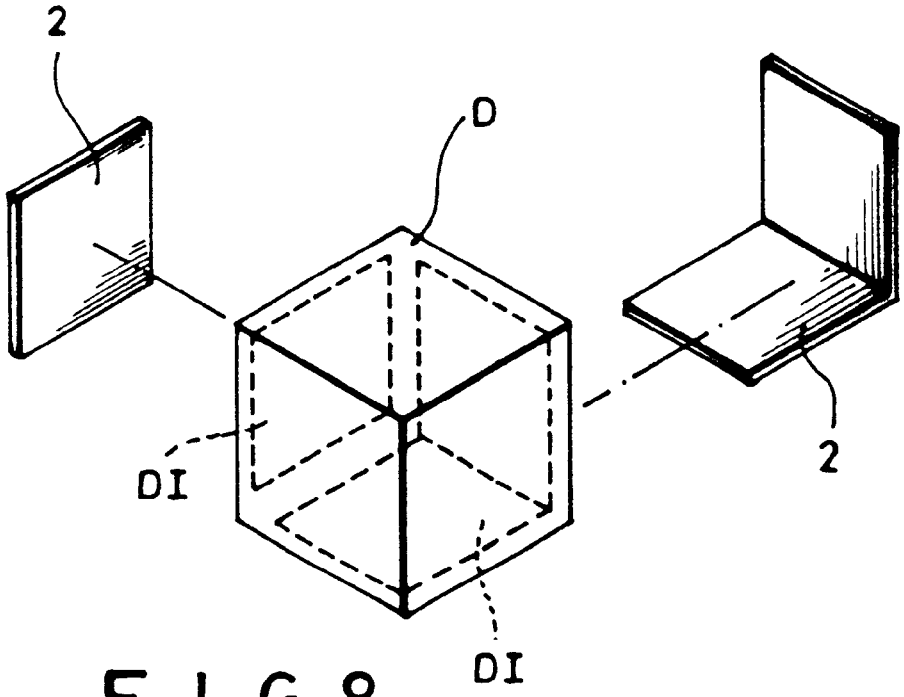
FIG. 8 is an exploded view of a fourth square block according to the present invention.
Figure 9:
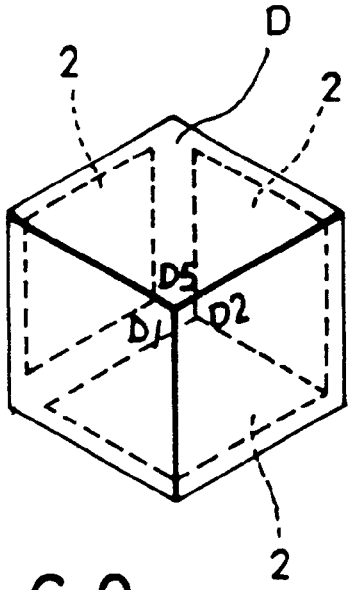
FIG. 9 is an assembly view of FIG. 8.

Referring to FIGS. 8 and 9, the fourth square block D comprises two flat recesses D1 of different sizes, namely, the first flat recess disposed at one peripheral side, and the second flat recess extended over two adjacent sides and disposed at right angles relative to the first flat recess. Two metal sheets 2 (one flat metal sheet and one angled metal sheet) are respectively and fixedly mounted in the flat recesses DII at the fourth square block D in a flush manner.

Figure 1:
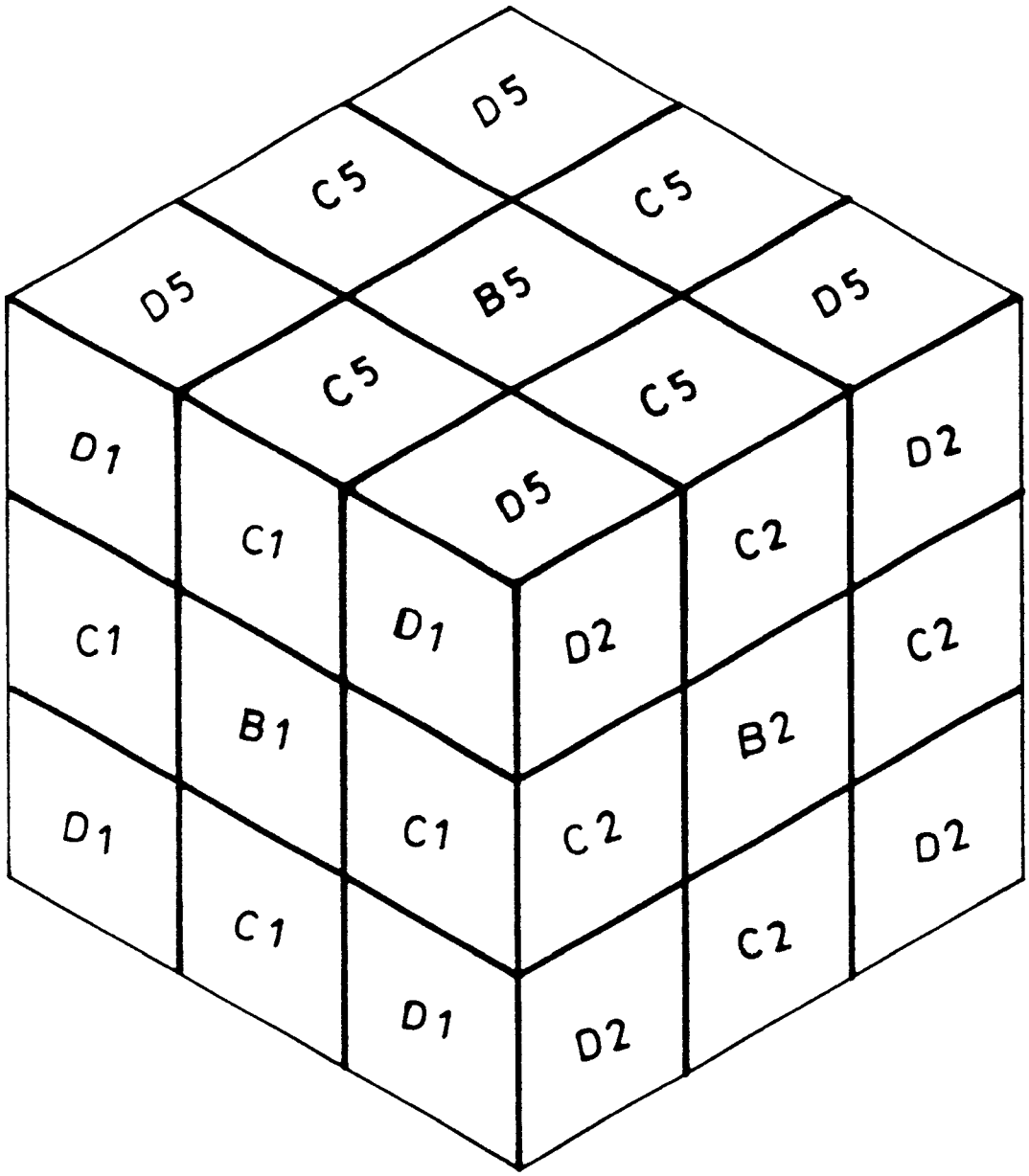
FIG. 1 is an elevational view of a puzzle block according to the present invention.
Figure 10:
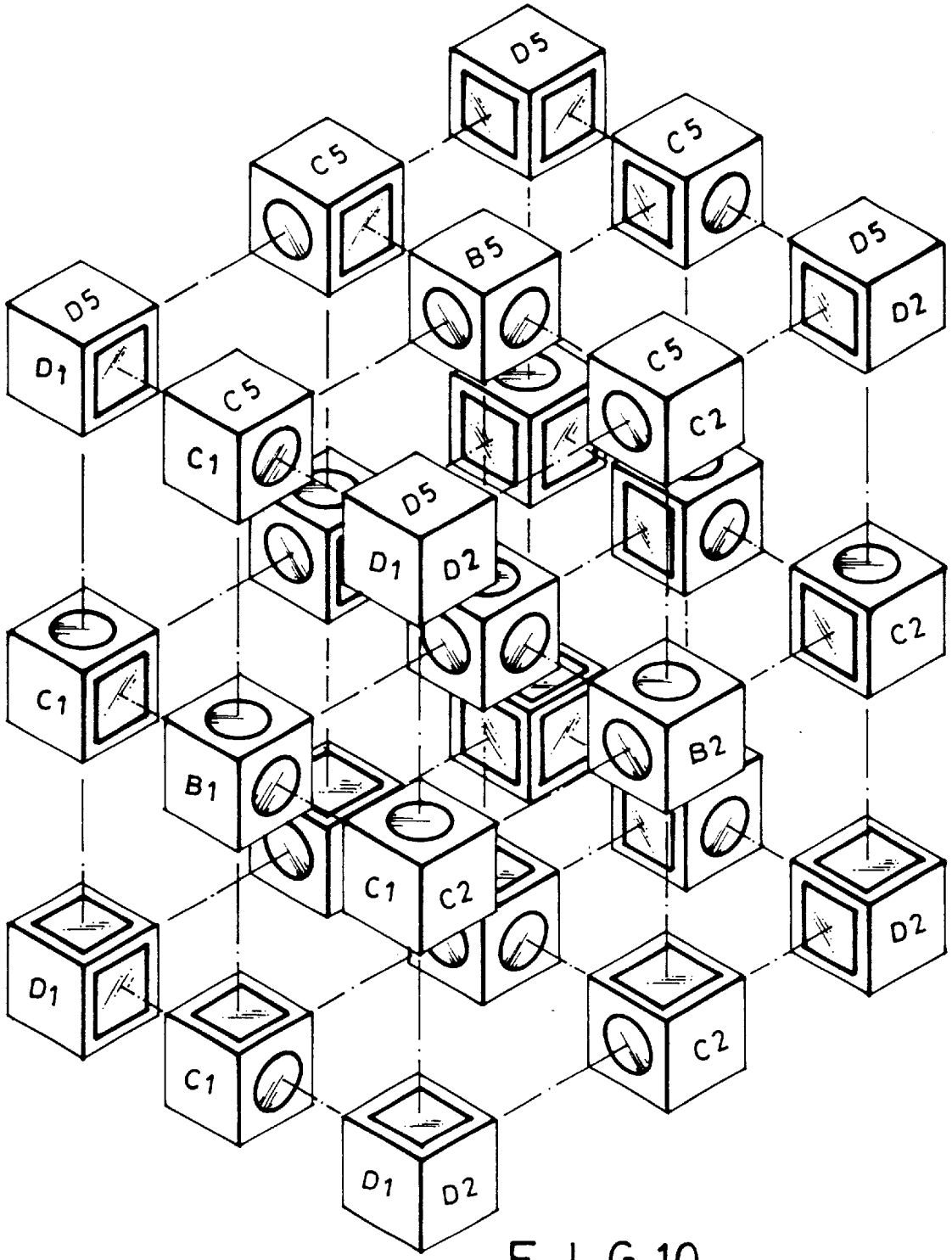
FIG. 10 is an exploded view of the puzzle block according to the present invention.

Referring to FIG. 10 and FIG. 1 again, the aforesaid 27 square blocks are arranged into a puzzle block, such that the magnets 1 at the first square blocks A respectively attract the metal sheet 1 at each of the second square blocks B, the metal sheets 2 at the third square blocks C are respectively attracted by the magnets 1 at the second square blocks B, and the metal sheets 2 at the fourth square blocks D are respectively attracted by the magnets 1 at the third square blocks C. When assembled, the puzzle block has 9 comprises six sides, namely, the first side B1C1D1, the second side B2C2D2, the third side B3C3D3 (opposite to the first side B1C1D1), the fourth side B4C4D4 (opposite to the second side B2C2D2), the fifth side B5C5D5, and the sixth side B6C6D6 (opposite to the fifth side B5C5D5). Each of the six sides of the puzzle block comprises 9 small planes including DCD, CBC, DCD planes set in a crossed arrangement, i.e., a DCD arrangement is shown at every transverse or vertical line, and a DBD arrangement is shown at every diagonal line. When rotating the square blocks relative to one another, magnets are moved relative to metal sheets. Therefore, when the position of one square block at each side B1C1D1 of the puzzle block is shifted, the second square block B at the respective side of the puzzle block is maintained at the center of the respective side of the puzzle block, each third square block at each side of the puzzle block is disposed on the middle at the border area at the corresponding side of the puzzle block, and each fourth square block D is disposed in one corner at each side of the puzzle block, i.e., the respective metal sheets are maintained attracted by the respective magnets when rotating the square blocks of the puzzle block without causing a magnetic repulsion between each two adjacent square blocks, or a disconnection between each two adjacent square blocks due to disappearance of magnetic attraction.

While only one embodiment of the present invention has been shown and described, it will be understood that various modifications and changes could be made thereunto without departing from the spirit and scope of the invention disclosed. Two separate flat metal sheets may be used instead of one angled metal sheet for fastening to two sides at one third or fourth square block.

What the invention claimed is:

1. A puzzle block comprising:

a first cube block having six sides each formed with a first recessed hole in which is fitted a magnet in a flush manner;

six second cube blocks each having a second recessed hole at one of four peripheral sides thereof and a first flat recess at one of the other two sides thereof, a respective magnet being fixedly mounted in said second recessed hole at each of said four peripheral sides in a flush manner, a metal sheet being fixedly mounted in said first flat recess in a flush manner;

twelve third cube blocks each having a third recessed hole at each of two opposite sides thereof and a second flat recess extended over two adjacent sides between the two opposite sides which carry a respective third recessed hole, a respective magnet fixedly mounted in each third recessed hole in a flush manner; and eight fourth cube blocks each comprising a plurality of metal sheets respectively provided at three adjacent sides thereof;

wherein said first cube blocks, said second cube blocks, said third cube blocks and said fourth cube blocks are attached to one another forming a combination block such that the magnets at said first cube blocks respectively attract the metal sheet at each of said second cube blocks, the metal sheets at said third cube blocks are respectively attracted by the magnets at said second cube blocks, and the metal sheets at said fourth cube blocks are respectively attracted by the magnets at said third cube blocks, the magnets at said first, second, and third cube blocks are respectively disposed in flush with periphery of respective cube blocks, and the metal sheets at said second, third and fourth cube blocks are respectively disposed in flush with the periphery of the cube blocks, and said first, second, and third cube blocks each have a plurality of recessed holes at the periphery thereof which receive the respective magnets, and the respective magnets are respectively fixedly fastened to the respective recessed holes at said first, second and third cube blocks by an adhesive.

* * * * *